US009379430B2

(12) United States Patent
Kerselaers

(10) Patent No.: US 9,379,430 B2
(45) Date of Patent: Jun. 28, 2016

(54) MULTIBAND ANTENNA

(75) Inventor: Anthony Kerselaers, Herselt (BE)

(73) Assignee: NXP B.V., Eindhoven (NL)

( * ) Notice: Subject to any disclaimer, the term of this patent is extended or adjusted under 35 U.S.C. 154(b) by 532 days.

(21) Appl. No.: 13/406,550

(22) Filed: Feb. 28, 2012

(65) Prior Publication Data

US 2012/0223863 A1 Sep. 6, 2012

(30) Foreign Application Priority Data

Mar. 3, 2011 (EP) ..... 11250242

(51) Int. Cl.

| | |
|---|---|
| ***H01Q 1/38*** | (2006.01) |
| ***H01Q 1/32*** | (2006.01) |
| ***H01Q 9/38*** | (2006.01) |
| ***H01Q 21/30*** | (2006.01) |
| ***H01Q 5/371*** | (2015.01) |

(52) U.S. Cl.

CPC ..... *H01Q 1/3275* (2013.01); *H01Q 1/38* (2013.01); *H01Q 5/371* (2015.01); *H01Q 9/38* (2013.01); *H01Q 21/30* (2013.01)

(58) Field of Classification Search

USPC ..... 343/700 MS, 795, 713, 702

See application file for complete search history.

(56) References Cited

U.S. PATENT DOCUMENTS

| | | | | |
|---|---|---|---|---|
| 4,395,713 | A | 7/1983 | Nelson et al. | |
| 5,754,145 | A | 5/1998 | Evans | |
| 5,828,340 | A * | 10/1998 | Johnson | H01Q 1/38 343/700 MS |
| 6,417,816 | B2 * | 7/2002 | Sadler | H01Q 1/243 343/702 |
| 6,819,290 | B2 * | 11/2004 | Hani et al. | 343/700 MS |
| 7,274,334 | B2 | 9/2007 | O'Riordan et al. | |
| 7,573,433 | B2 | 8/2009 | Qin | |
| 7,612,720 | B2 * | 11/2009 | Kerselaers | H01Q 9/285 343/700 MS |
| 2003/0076264 | A1 * | 4/2003 | Yuanzhu | H01Q 1/38 343/700 MS |
| 2005/0174296 | A1 * | 8/2005 | Okado | H01Q 1/22 343/795 |
| 2008/0001824 | A1 | 1/2008 | Casteneda et al. | |
| 2008/0180342 | A1 | 7/2008 | Kerselaers | |

FOREIGN PATENT DOCUMENTS

| | | | |
|---|---|---|---|
| CN | 1841846 | A | 10/2006 |
| CN | 101162801 | A | 4/2008 |

(Continued)

OTHER PUBLICATIONS

Rosu, Iulian, "PIFA—Planar Inverted F Antenna", retrieved from the Internet on Feb. 3, 2011 at: http://www.qsl.net/va3iul/Antenna/PIFA/PIFA_Planar_Inverted_F_Antenna.pdf, 4 pgs.

Extended European Search Report for European patent appln. No. 11250242.2 (Aug. 11, 2011).

(Continued)

*Primary Examiner* — Hoang V Nguyen
*Assistant Examiner* — Hai Tran

(57) ABSTRACT

A multiband antenna comprising a substrate having first and second surfaces. A first conductive plate is provided on the first surface and a second conductive plate is provided on the second surface. The second conductive plate at least partially overlaps the first conductive plate in the plane of the substrate. The antenna also comprises a ground plane, wherein the substrate is connected to and is substantially perpendicular to the ground plane, and a feeding port (412) that is electrically coupled to both the first and second conductive plates. The first conductive plate is configured to transmit or receive signals in a first frequency band and the second conductive plate (408) is configured to transmit or receive signals in a second frequency band.

20 Claims, 9 Drawing Sheets

(56) References Cited

FOREIGN PATENT DOCUMENTS

| | | | |
|---|---|---|---|
| DE | 102005054286 | A1 | 5/2007 |
| EP | 1 414 109 | A2 | 4/2004 |
| EP | 2 256859 | A1 | 12/2010 |
| JP | 2003133838 | | 5/2009 |
| WO | 2008/123683 | A1 | 10/2008 |

OTHER PUBLICATIONS

Office Action for counterpart application CN 201210048070.5 Dec. 31, 2013.
Office Action dated May 8, 2014 issued for European Patent Appl. No. 11 250 242.2-1812.

* cited by examiner

MULTIBAND ANTENNA

CROSS-REFERENCE TO RELATED APPLICATIONS

This application claims the priority under 35 U.S.C. §119 of European patent application no. 11250242.2, filed on Mar. 3, 2011, the contents of which are incorporated by reference herein.

The present disclosure relates to the field of multiband antennas, in particular, although not exclusively, to a compact multiband antenna for transmitting signals from, and receiving signals at, an automobile in a plurality of frequency bands.

Today's vehicles are equipped with many wireless devices so as to receive radio and television broadcasts, for cellular telecommunications and GPS signals for navigation. In the future, even more communication systems will be implemented for "intelligent driving" such as dedicated short range communication (DSRC). As a result, the number of automotive antennas is increasing and miniaturization requirements are becoming an important consideration for reducing the unit cost price of the antenna systems. The largest cost is the cabling between the antennas and the respective electronic devices; typically this cabling costs five Euro per coaxial cable.

Multiple antennas are often concentrated in one antenna unit, called a "shark fin" unit. A shark fin unit may be positioned on the back of the roof top of a car.

The listing or discussion of a prior-published document or any background in the specification should not necessarily be taken as an acknowledgement that the document or background is part of the state of the art or is common general knowledge.

According to a first aspect of the invention, there is provided a multiband antenna comprising:

- a substrate having a first surface and a second surface;
- a first conductive plate on the first surface of the substrate;
- a second conductive plate on the second surface of the substrate, wherein the second conductive plate at least partially overlaps the first conductive plate in the plane of the substrate,
- a ground plane, wherein the substrate is connected to the ground plane and is substantially perpendicular to the ground plane;
- a feeding port that is electrically coupled to both the first conductive plate and the second conductive plate; and
- wherein the first conductive plate is configured to transmit or receive signals in a first frequency band and the second conductive plate is configured to transmit or receive signals in a second frequency band.

Such an antenna can be suitable for sending and receiving signals with frequencies of about 2.5 GHz and in excess of 5 GHz in the presence of the ground plane, and have a physical size that is suitable for fitting within the constraints of a known shark fin unit for an automobile. When the shark fin unit is located on the rooftop of a vehicle, the vehicle can be considered as an extension of the ground plane, and therefore it can be important that the antenna is operable in the presence of such a large grounding body.

The first and second conductive plates may extend away from the ground plane in longitudinal direction. The length of the first and second conductive plates in the longitudinal direction may define the frequencies of signals that the plates are configured to transmit and receive. The length of the first and second conductive plates in the longitudinal direction corresponds to quarter wavelength monopole antennas for the frequencies of signals that the plates are configured to transmit and receive. Such a structure can be advantageous for restricting the dimensions of the antenna such that it can fit within known shark fin units. For example, the ground plane can be a bottom plate of the shark fin unit and the longitudinally extending conductive plates can extend vertically within the shark fin housing.

Less than about 5%, 10%, 15% or 20% of the second conductive plate may overlap the first conductive plate. Less than about 25%, 35%, 45% or 55% of the first conductive plate may overlap the second conductive plate. The proportion of the first conductive plate that may overlap the second conductive plate may differ from the proportion of the second conductive plate that may overlap the first conductive plate by at least 5%, 10%, 15% or 20%. In this way, the amount of capacitive coupling between the two conductive plates can be limited so that the antenna can still operate satisfactorily in the presence of a large grounding body such as a vehicle to which the multiband antenna is attached.

The antenna may further comprise a connecting conductor that is configured to provide an electrical connection between the first conductive plate and the second conductive plate. The connecting conductor may also be coupled to the feeding port. The connecting conductor may ensure that the signal is fed to the same position, in the plane of the substrate, of the first conductive plate and second conductive plate. The provision of such a connecting conductor can ensure that currents flowing through the two conductive plates are in-phase and therefore do not negatively interfere with each other. In addition, the connecting conductor can enable a single feeding port to be used that can conduct signals to and from both the first and second conductive plates. The connecting conductor may be a via that provides an electrical connection through the substrate.

The feeding port may emanate from either the first or second surface of the substrate. The feeding port may be directly coupled to the first conductive plate and/or the second conductive plate.

The first conductive plate may be rectangular. The second conductive plate may have a substantially square or rectangular section at an open end, and a frusto-triangular section at a feeding end. In this way, the first conductive plate can provide a high level of performance for a lower frequency band, which may be a relatively narrow frequency band. The second conductor can provide a large bandwidth for the higher frequency band that can be advantageous as it can cover a wide range of communication standards that may have frequencies in excess of about 5 GHz.

The first conductive plate may be configured to transmit and receive signals with a frequency of about 2.5 GHz. The second conductive plate may be configured to transmit and receive signals with a frequency greater than about 5 GHz.

The feeding port may be coupled to the second conductive plate at two laterally spaced apart locations. This is one example of a structure that can increase the bandwidth of the higher frequency band by distributing the current through the second conductive plate in a lateral direction. In this example the connecting conductor may be placed at one of these two laterally spaced apart locations. Alternatively, the connecting conductor may be positioned at a third laterally spaced apart location.

The antenna may comprise a single feeding port for both the first conductive plate and the second conductive plate. The ground plane may be configured to be connected to a conducting shield of a coaxial cable. The feeding port may be configured to be connected to an inner conductor of a coaxial cable, and the provision of a single feeding port can reduce the cost and complexity that would be associated with more than one coaxial connection.

The maximum height of the antenna may be less than 55 mm. It may not be possible to manufacture prior art antennas that have a suitable frequency response for the frequency bands of interest that is capable of fitting within known shark fin units.

There may be provided a shark fin unit comprising any multiband antenna disclosed herein.

There may be provided an automobile, such as a car, fitted with any multiband antenna or shark fin unit disclosed herein.

A description is now given, by way of example only, with reference to the accompanying drawings, in which.

Figure 4A:
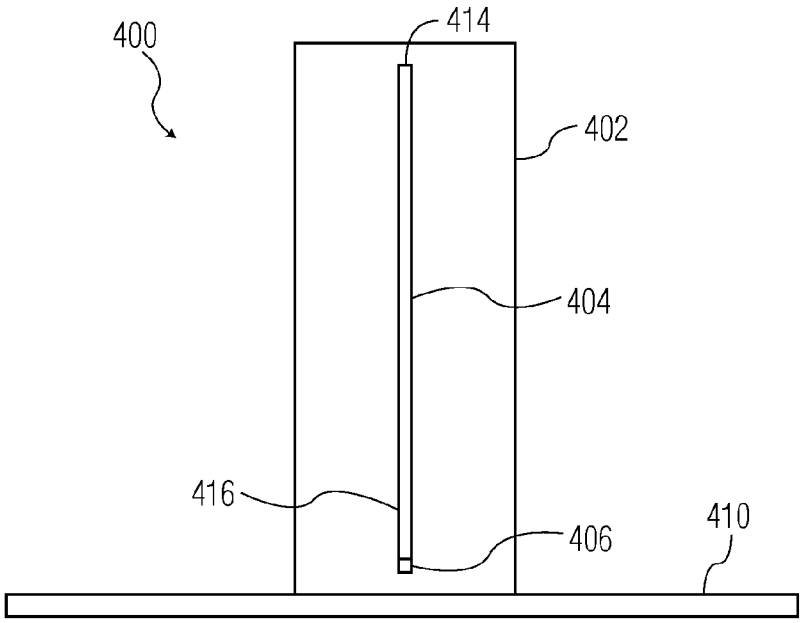
Figure 4B:
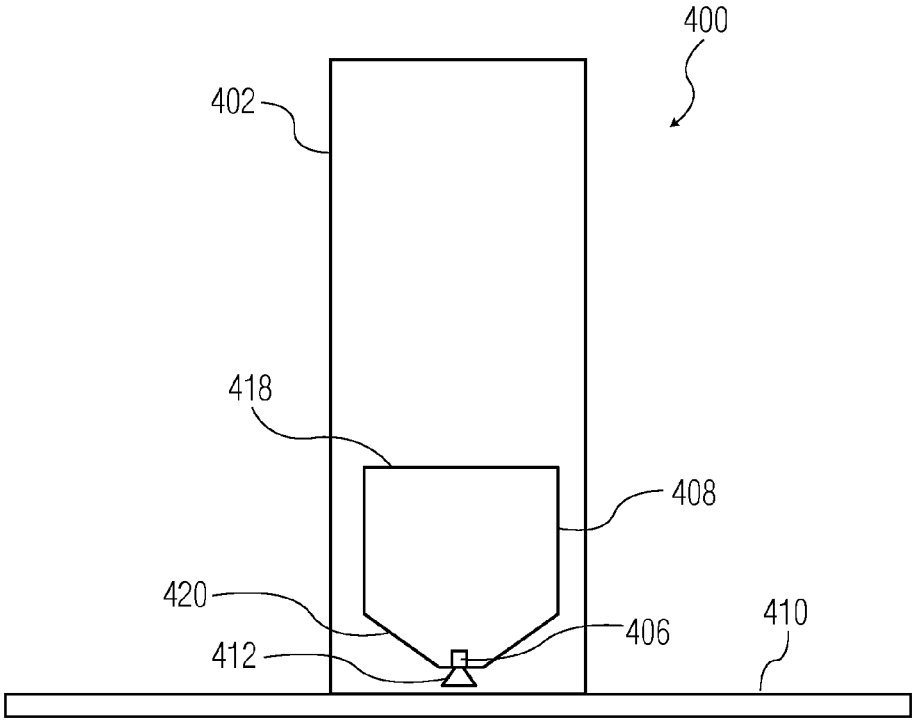
Figure 4C:
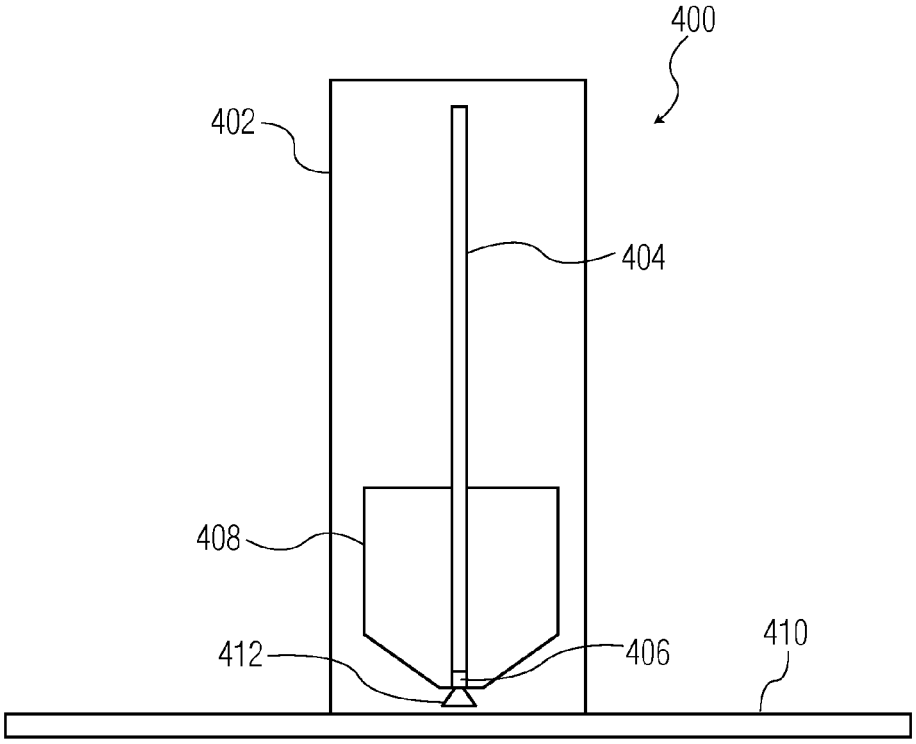
Figure 5:
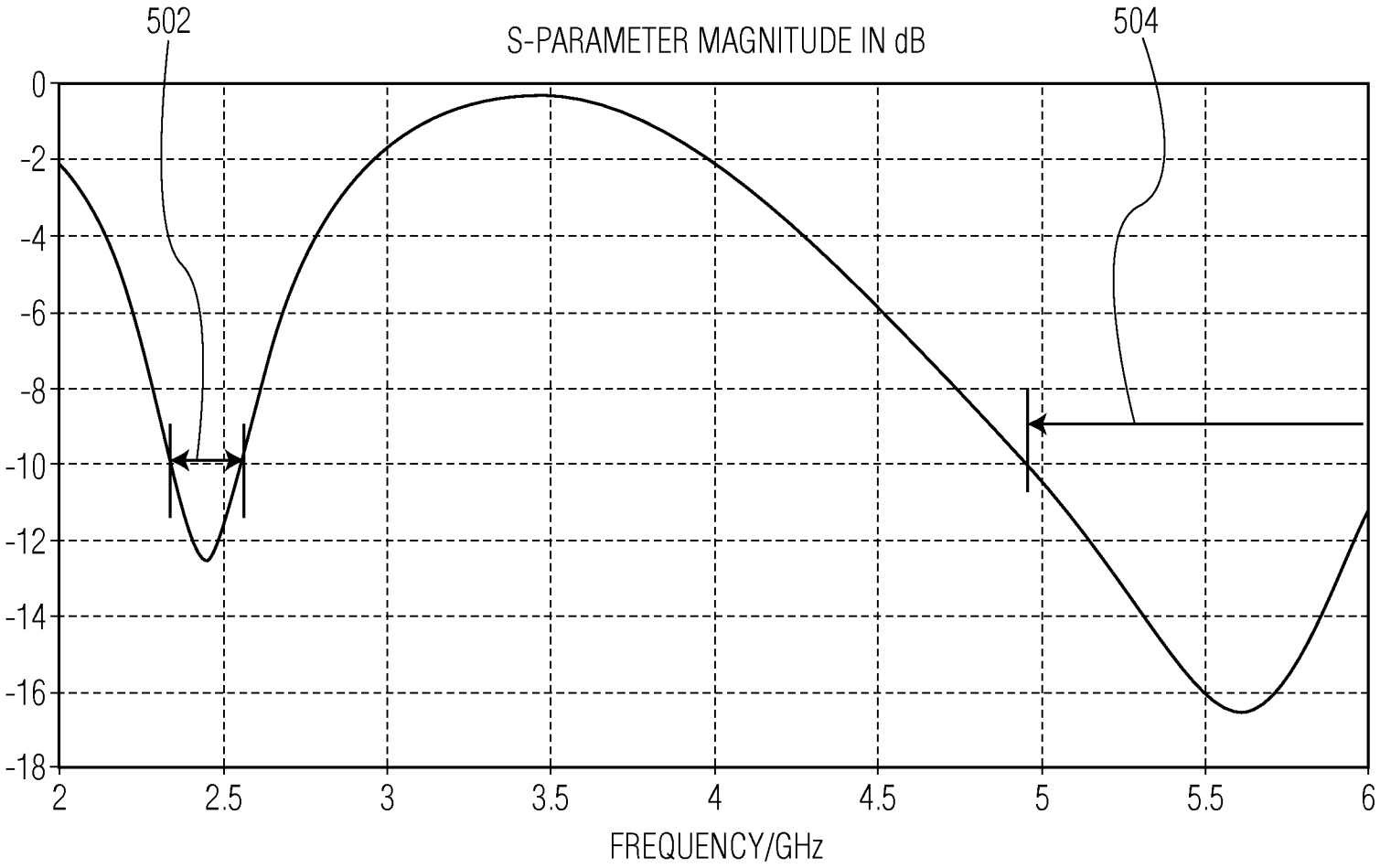
Figure 6:
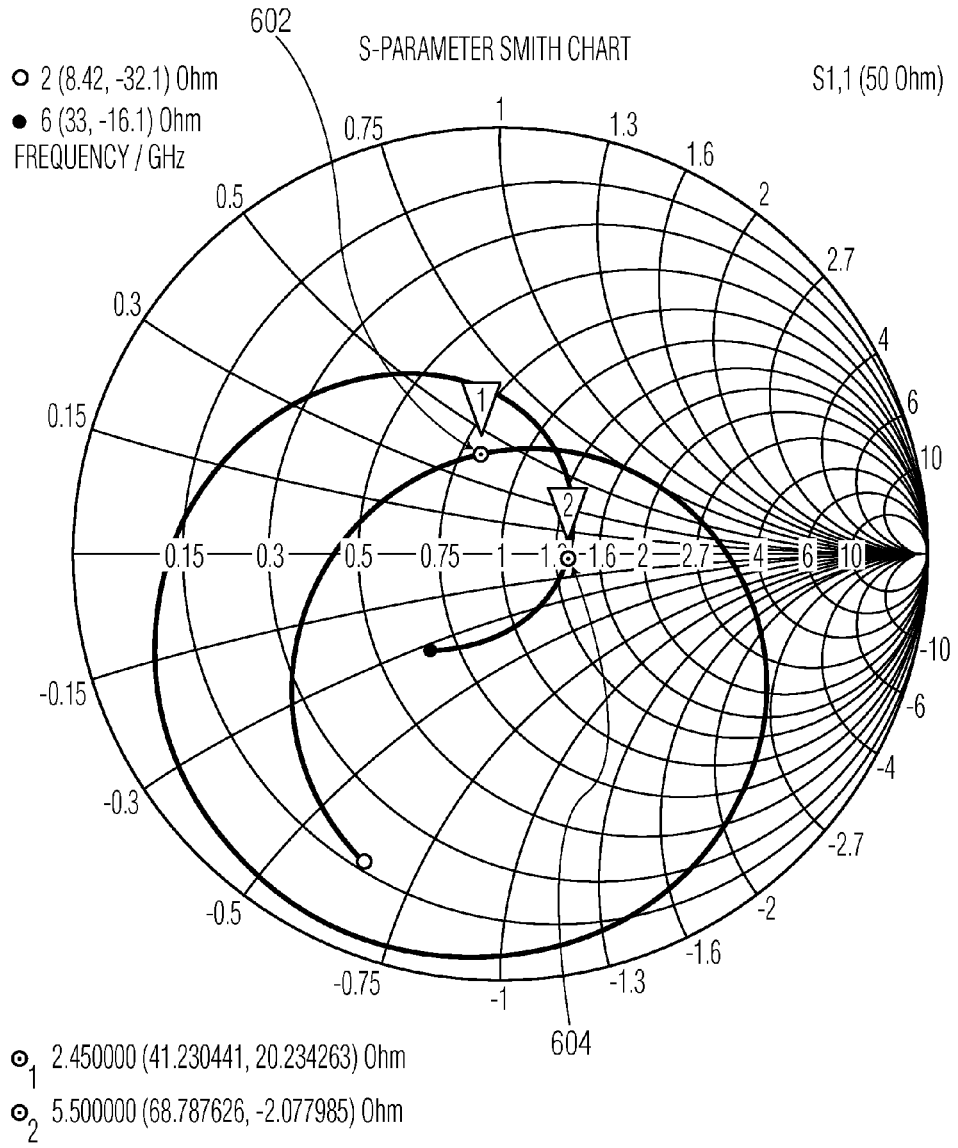
Figure 7:
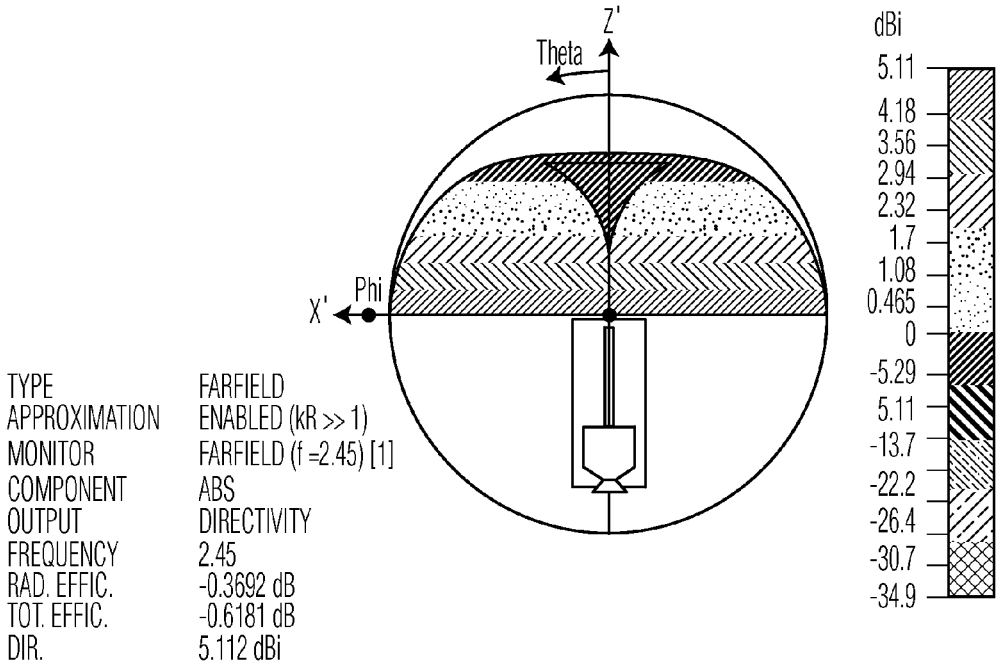
Figure 8:
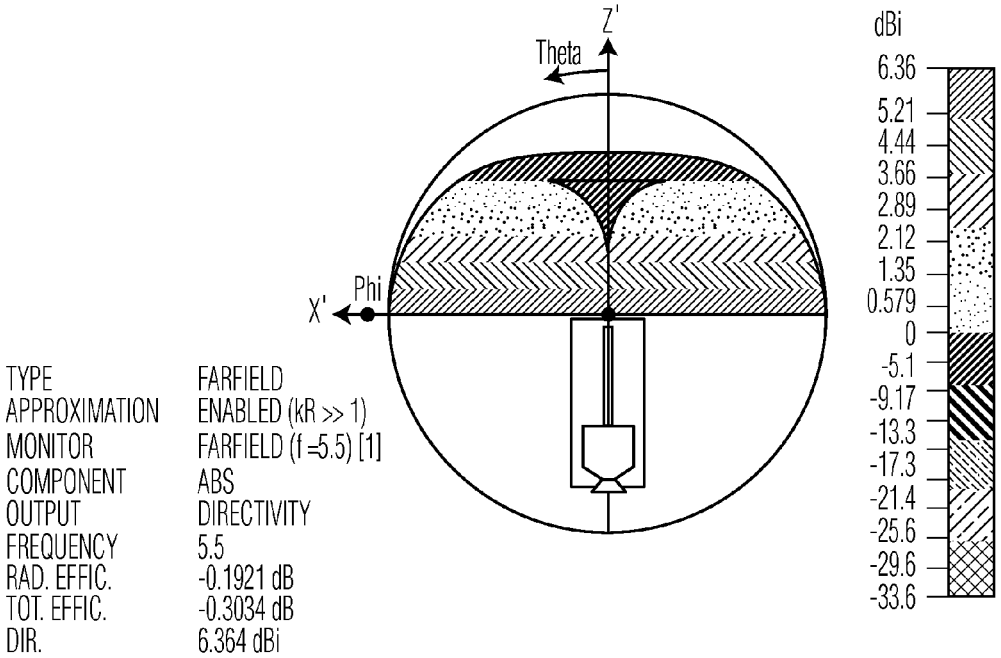
Figure 9A:
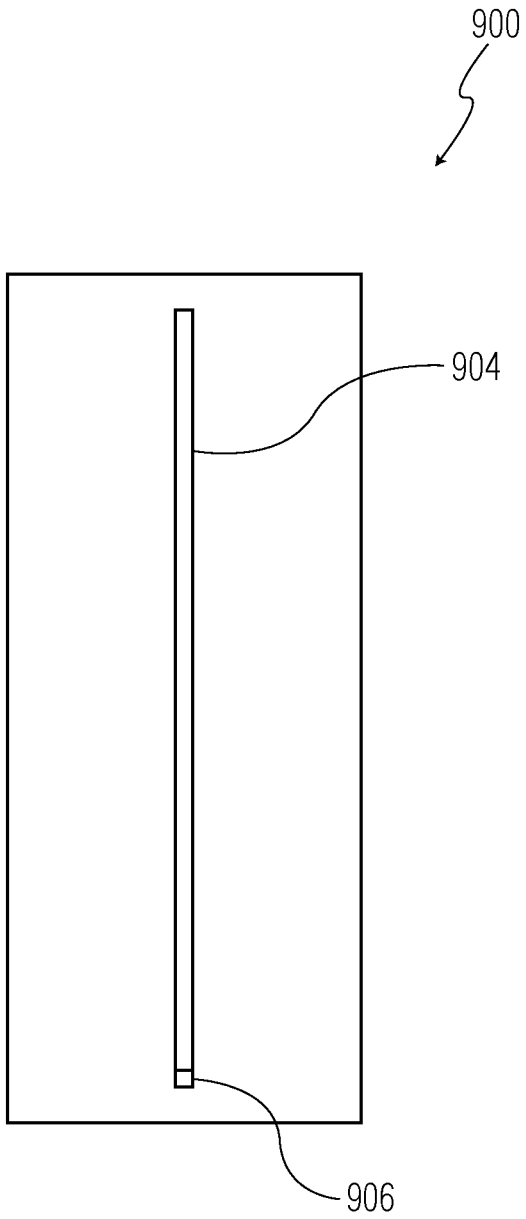
Figure 9B:
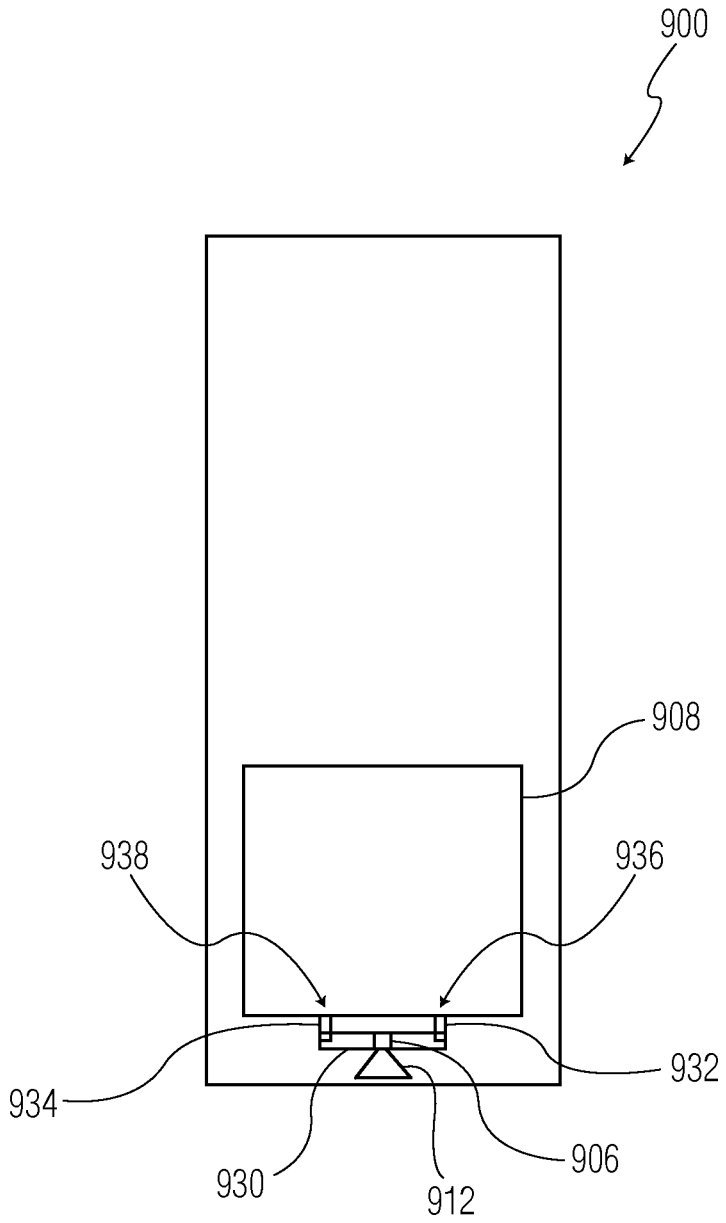
Figure 9C:
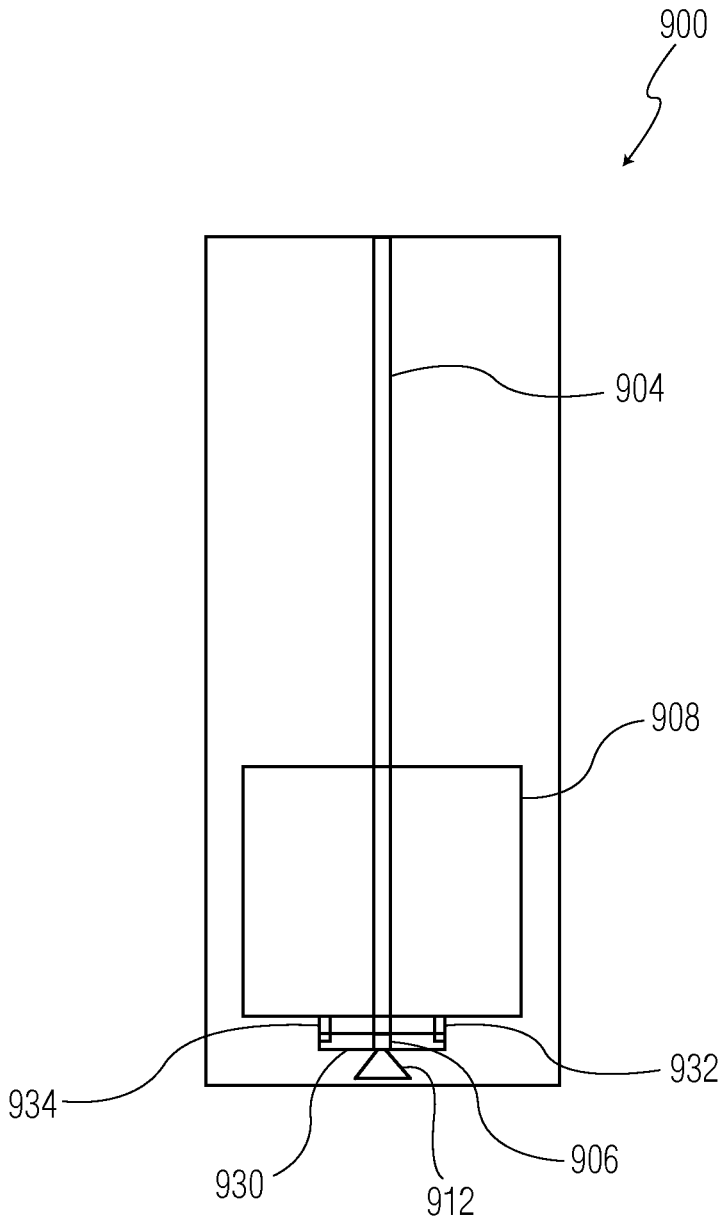

FIGS. 4*a* to 4*c* show an antenna according to an embodiment of the invention; FIG. 5 illustrates graphically the return loss of an antenna according to an embodiment of the invention;

FIG. 6 shows graphically the input impedance of an antenna according to an embodiment of the invention on a Smith chart;

FIG. 7 illustrates graphically the simulated radiation pattern of an antenna according to an embodiment of the invention operating a low frequency;

FIG. 8 illustrates graphically the simulated radiation pattern of an antenna according to an embodiment of the invention operating at a high frequency; and FIGS. 9*a* to 9*c* illustrate an antenna according to another embodiment of the invention.

One or more embodiments of the invention can relate to a multiband antenna having a first conductive plate and a second conductive plate on opposite sides of a substrate. The substrate can be connected to a ground plane such that the substrate and ground plane are perpendicular to each other. The second conductive plate at least partially overlaps the first conductive plate in the plane of the substrate. The first conductive plate can transmit or receive signals in a first frequency band and the second conductive plate can transmit or receive signals in a second frequency band. Such an antenna can be suitable for sending and receiving signals with frequencies of about 2.5 GHz and also in excess of 5 GHz in the presence of a ground plane, and have a physical size that is suitable for fitting within the constraints of a known shark fin unit for an automobile. When the shark fin unit is located on the rooftop of a vehicle, the vehicle can be considered as an extension of the ground plane, and therefore it can be important that the antenna is operable in the presence of such a large grounding body.

Today there is a strong drive towards "green driving" that has resulted in several projects concerning "intelligent driving". New communication systems that are able to communicate between cars (car2car) and between a car and the roadside are in a definition phase. As yet there is no uniform global standard, but it is expected that the majority of such systems will work in the 5.8 to 6 GHz band. Such communication standards are expected to relate to communicating safety-related information and therefore their successful transmission and reception may be very important.

Multiple antennas will need to be packed together in a small volume and positioned on the roof tops of vehicles in so called "antenna units". It has been found that for car2car communication at least two known antennas are required in order to combat multipath fading and to cope with the different relative directions of the cars. Multiple coaxial cables are required to connect the antennas to electronic devices. These cables pose a major cost burden. It is also expected that in future more electronic components will be positioned close to the antenna, in which case many of these expensive cables can be omitted.

Cellular communication is performed in several different frequency bands in different territories. In Europe the frequency bands below are currently used:

GSM 900: 880-960 MHz
GSM 1800: 1710-1880 MHz
UMTS: 1920-2170 MHz
other frequency bands are foreseen for future use.

Cellular communication in the USA currently uses the frequency bands described below:

GSM 850: 824-894 MHz
PCS: 1850-1990 MHz
other frequency bands are foreseen for future use.

Other systems that may be used with intelligent driving are:

GPS: 1575.42±1.023 MHz
WLAN 5.9: 5.875-5.905 MHz
WLAN 2.4: 2404-2489 MHz

Figure 1:
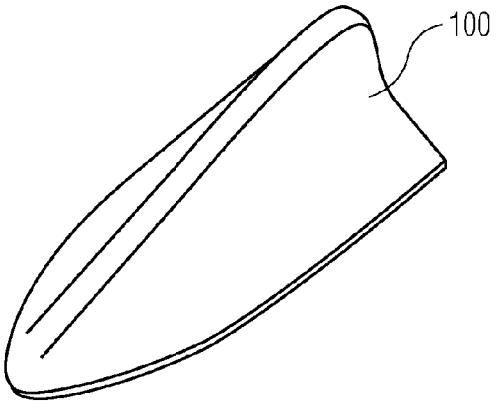
FIG. 1 shows a shark fin antenna unit.

FIG. 1 shows a typical shark fin antenna unit 100 that may be placed at the rear of the rooftop of a vehicle. Antennas inside the antenna unit 100 are restricted in dimensions and the antennas have to be adapted to fit the unit 100. The antenna unit 100 also has stringent requirements for weather protection, shock behaviour and sensitivity to rises in temperature. The antenna unit 100 is encapsulated by a plastic randome.

Typical dimensions of the antenna unit 100 are:

- maximum height of 50 to 55 mm (external randome height of 60 mm);
- length of 120 mm (external randome length of 140 mm); and
- width of 40 mm (external randome width of 50 mm).

Figure 2:
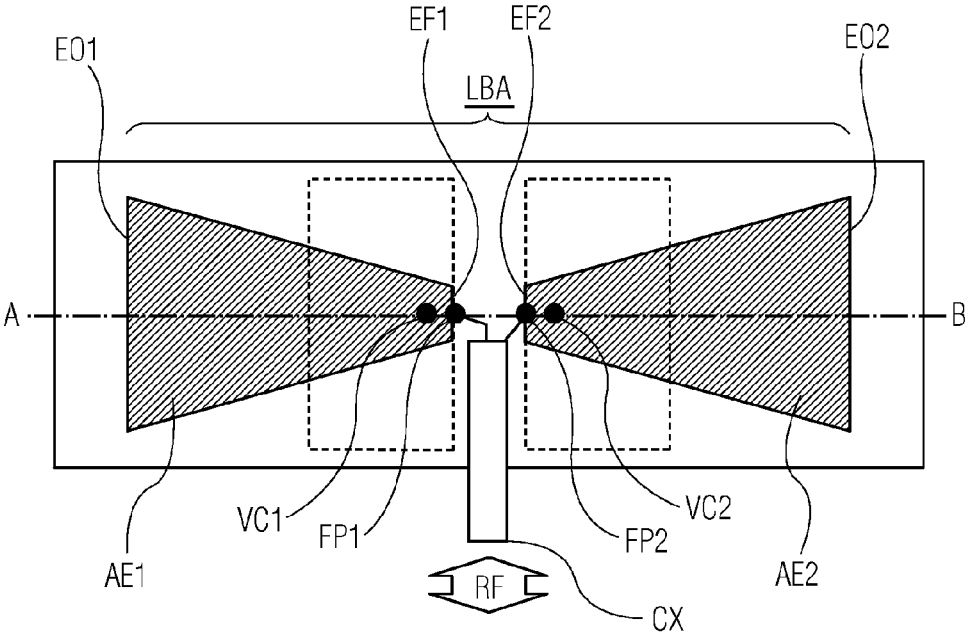
FIG. 2 PRIOR ART
FIG. 2 shows a prior art antenna.

FIG. 2 illustrates the prior art wireless link module of U.S. Pat. No. 7,612,720 (B2). The wireless link module comprises a lower band antenna and a higher band antenna. Each of these antennas comprises an antenna element with a feeding end and an open end. The respective antenna elements are substantially capacitively coupled.

Figure 3:
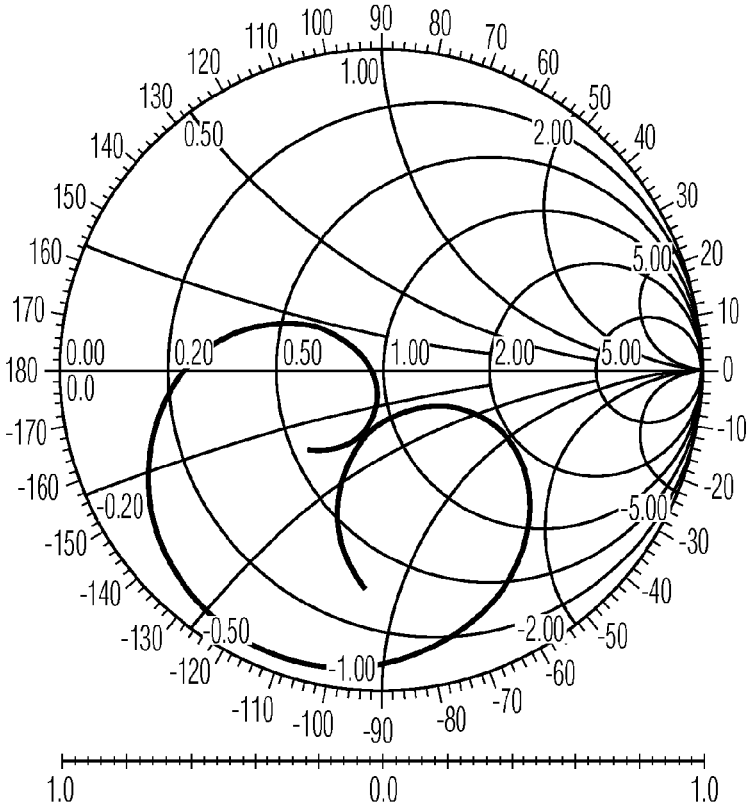
FIG. 3 PRIOR ART
FIG. 3 shows graphically the input impedance of the prior art antenna of FIG. 2 on a Smith chart.

FIG. 3 illustrates the input impedance of the prior art antenna of FIG. 2 on a Smith chart. The Smith chart is a commonly used method of displaying complex information related to the impedance performance of an antenna. The circumferential axis shows the reactive coefficient of the antenna relative to a reference level of 50 Ω. The horizontal linear axis shows the resistive coefficient relative to this reference level. The function plotted on the graph shows the two components of the impedance of the antenna at different frequencies, with the frequency increasing as the function traces a clockwise motion.

It can be seen from FIG. 3 that the antenna heavily relies on capacitive coupling as the function is almost entirely below the horizontal linear access axis. This antenna is of the balanced type. It is well known in the art that balanced antennas cannot be operated close to a ground plane. The input impedance and efficiency of balanced antennas that are close to a ground plane are very low.

One or more embodiments disclosed herein relate to a multiband antenna that can be used in proximity with a large grounding body, such as the large effective ground plane that is present when an antenna is situated on the roof of a vehicle.

FIGS. 4*a*, 4*b* and 4*c* illustrate a multiband antenna 400 according to an embodiment of the invention. FIG. 4*a* shows a front view of the antenna 400, and illustrates a first, front, surface of the substrate 402. FIG. 4*b* shows a back view of the antenna 400, and illustrates a second, reverse, surface of the substrate 402. FIG. 4*c* shows a composite view of the front and back views of the antenna.

The antenna 400 has a substrate 402, with a first conductive plate 404 on a first surface of the substrate 402 and a second conductive plate 408 on a second, opposite side of the substrate 402. The first conductive plate 404 provides a lower band antenna and the second conductive plate 408 provides a higher band antenna. In this example, the first and second conductive plates 404, 408 are quarter wavelength monopole antennas.

The substrate 402 can be a printed circuit board (PCB) material such as FR4, or any dielectric material that has sufficient performance for the frequency bands of operation. The substrate 402 can be low cost in terms of materials and also low cost for manufacturing as existing technologies for printed circuit boards can be used to provide the conductive plates 404, 408 on the substrate 402. The conductive plates 404, 408 can be copper or any other material that has sufficient performance for the frequency bands of operation. The conductive plates 404, 408 can be very thin, for example 35 micrometers. In some examples, the conductive plates 404, 408 can be covered by a protective layer to prevent or reduce oxidation of the conductive plates 404, 408 and/or to reduce degradation due to temperature. Such requirements may be beneficial in order for the antenna 200 to satisfy automotive requirements.

The substrate 402 may be, for example, a glass epoxy material, which is commonly used for printed circuit boards. The substrate 402 may be, for example, 1.2 millimeters (mm) thick, 15 mm wide and 25 mm long. The first conductive plate 404 and the second conductive plate 408 may be formed by etching copper, which is commonly used for printed circuit boards. Such an antenna construction can be considered convenient and low cost in terms of materials and construction.

A connecting conductor 406 provides an electrical connection between the first and second conductive plates 404, 408. In this example the connecting conductor 406 is a via that passes through the substrate 402, although in other embodiments different types of connecting conductor 406 can be used in order to provide a direct electrical connection between the two conductive plates 404, 408. Providing a direct electrical connection between the two conductive plates 404, 408 causes the electrical current that flows through the two conductive plates 404, 408 to be in-phase at the feeding end of the two conductive plates 404, 408 and therefore the current in one conductive plate 404, 408 does not interfere with the current in the other plate 404, 408. This is described and illustrated below with reference to FIGS. 7 and 8 where it can be seen that the directionality of the antenna is not negatively affected by the combination of two conductive plates 404, 408.

A feeding port 412 is coupled to the connecting conductor 406 and is configured to conduct signals that are received at, or transmitted from, the antenna 400. In use, the feeding port 412 may be connected to an inner conductor of a coaxial cable. An advantage provided by the single feeding port 412 and connecting conductor 406 is that only a single feed is required, which can reduce the cost of the antenna and coaxial cable that is required. The outer shielding conductor of such a coaxial cable may be connected to a ground plane 410, which is described in more detail below.

The antenna assembly 400 also has a ground plane 410. The substrate 402 is attached to the ground plane 410 such that it is perpendicular to the ground plane 410. In use, the substrate can be positioned vertically with reference to the rooftop of a vehicle. The front surface of the substrate 402 supports the first conductive plate 404, which is perpendicular to the ground plane 410. Similarly, the back surface of the substrate 402 supports the second conductive plate 408, which is also perpendicular to the ground plane 410.

Each conductive plate 404, 408 may be considered as an antenna element in the form of a conductive path that extends from a feeding end 416, 420 to an open end 414, 418. The feeding ends 416, 420 are coupled to the connecting conductor 406, which in turn is connected to the feeding port 412 in order to conduct signals to and from the antenna 400. The length of the conductive path of each conductive plate 404, 408 is approximately a quarter of a wavelength of the signals that are to be received at, or transmitted from, that conductive plate 404, 408. That is, the distance between the feeding end 416, 420 and the open end 414, 418 of an antenna element is substantially a quarter of a wavelength. The conductive plates 404, 480 can be considered as extending in a longitudinal direction from their feeding ends 416, 420 to their open ends 414, 418.

The first conductive plate 404 in this example is rectangular in shape, and is significantly longer in a longitudinal direction than in a lateral direction. The rectangular first conductive plate 404 can be long and thin, for example the conductive plate 404 may be about 10 to 500 times longer (longitudinal length) than it is wide (lateral length).

The lateral width of the second conductive plate 408 is smaller at the feeding end 420 than at the open end 418. This can provide good input impedance coupling for the second conductive plate 408. In this example, the second conductive plate 408 has a substantially square or rectangular section at the open end 418, and a triangular or frusto-triangular section at the feeding end 406. The lateral width of the second conductive plate 408 may be similar to the longitudinal length of the second conductive plate 408. For example, the lateral width may be within about 2%, 5%, 8% or 50% of the longitudinal length.

The connecting conductor 406, which may also be referred to as an antenna coupling short, is relatively close to the respective feeding ends 416, 420 of the conductive plates 404, 408. For example, referring to the second conductive plate 418, the distance between the connecting conductor 406 and the feeding end 420 may be at least 10 times less than the distance between the connecting conductor 406 and the open end 418.

The antenna assembly 400 can be fed at only at one of the feeding ends 416, 420, the other feeding end 416, 420 can be left open.

The first and second conductive plates 404, 418 at least partially overlap, consequently there is capacitive coupling between first and second conductive plates 404, 418. It has been found that the capacitive coupling between the first and second conductive plates 404, 418 should not be too large as the multiband antenna will not function satisfactorily in the presence of the ground plane 410. In some examples, it can be advantageous for less than about 5%, 15% or 25% of the first conductive plate 404 to overlap with the second conductive plate 408, and/or for less than about 35%, 45% or 55% of the second conductive plate 408 to overlap with the first conductive plate 404.

The capacitive coupling between the conductive plates 404, 408 is distributed, as it were, over a significant portion of the respective conductive paths, which form these antenna elements. For example, let it be assumed that the connecting conductor 406 is absent. In that case, the first and second conductive plates 404, 408 could be considered as a capacitor. However, such a capacitor would have a relatively low impedance at the frequencies of interest (of the order of 2 GHz to in excess of 5 GHz), and therefore would not provide satisfactory performance at those frequencies. In contrast, the input impedance of the antenna 400 of FIG. 4 is sufficiently high due to the presence of the connecting conductor 406.

The multiband antenna 400 of FIG. 4 may be provided in a shark fin antenna module that is suitable for fixing to the rooftop of an automobile such as a car. The ground plane 410 may be a bottom plate of the shark fin module, and in some examples can be considered as an extension of the roof of the car. Such an antenna module may be used, for example, to establish communication in accordance with the IEEE802.11a/b/g/p standard.

Let it be assumed that a 2.45 GHz signal is applied to the antenna assembly 400 at the feeding port 406. The first conductive plate 404 of the lower band antenna constitutes a quarter wavelength monopole at this frequency. The antenna assembly 400 behaves almost as if only the lower band antenna of FIG. 4*a* were present; the higher band antenna of FIG. 4*b* has no significant influence. Two features of the antenna structure can account for this behavior. Firstly, the connecting conductor 406 can provide this functionality as it electrically couples the first conductive plate 404 to the second conductive plate 408 and their respective feeding ends 416, 420. The separated second conductive plate 408 presents a small capacitance with the first conductive plate 404 at the lower frequency band since the length of the second conductive plate 408 is only 0.25 wavelength at the lower frequency band. Secondly, the impedance due to the small capacitive coupling between the antenna element of FIG. 4*a* and the antenna element of FIG. 4*b* can allow a good impedance matching, and as a result can provide efficient operation while the antenna is operated at or near the resonant frequency.

Let it now be assumed that a 5.5 GHz signal is applied to the antenna assembly 400. The second conductive plate 408 of the higher band antenna constitutes a quarter wavelength monopole at this frequency. The first conductive plate 404 of the lower band antenna constitutes almost a half wavelength at this frequency, represents a relatively high impedance when taken in isolation. Consequently, the higher band antenna of FIG. 4*b* has the predominant effect on the input impedance of the antenna assembly 400 at 5.5 GHz, as the impedances of the higher and lower bands are in parallel with each other. The input impedance can allow a good impedance matching, and as a result can provide efficient operation while the antenna is operated at or near the resonant frequencies. However, the lower band antenna of FIG. 4*a* can play a significant role from a radiation point of view at 5.5 GHz (the higher frequency). This can be due to the weak capacitive coupling between the conductive plates 404, 408, which can cause a current to flow through the first conductive plate 404 of the lower band antenna when the higher frequency signal of 5.5 GHz is applied to the antenna assembly 400. As a result, the lower band antenna may radiate an electromagnetic field, which has an impact on the radiation characteristics of the antenna assembly at 5.5 GHz. However, and as indicated above, the connecting conductor 406 can cause the lower band antenna and the higher band antenna to have an equal phase at their feeding ends 416, 420, and therefore not to negatively influence each other. This is described in more detail in relation to FIGS. 7 and 8.

FIG. 5 illustrates the simulated return loss of an antenna with the structure of FIG. 4 that has been designed for operation at frequencies of about 2.45 GHz and 5.5 GHz. FIG. 6 illustrates the simulated input impedance of the same antenna in the form of a Smith chart.

A lower frequency band of operation 502 and a higher frequency band of operation 504 are shown in FIG. 5. The bandwidth of the frequency bands 502, 504 are shown at a reference level of return loss of −10 dB. The return loss is the loss of signal at the antenna due to poorly matched impedance of the antenna and the line that feeds it; it is the loss due to reflected signal. The return loss is a parameter commonly used to define the quality of matching of the radio frequency signal to the antenna. The centre frequencies of the two frequency bands are identified with references 602, 604 in FIG. 6.

It can be seen from FIG. 6 that the impedance 602 at 2.45 GHz is (41+20j) Ω, and that the impedance 604 at 5.5 GHz is (69+0j) Ω. As the reactance is either positive or zero the antenna coupling at these frequencies can be said not to have capacitive character; the capacitive coupling between the first conductive plate 404 and the second conductive plate 408 is very weak at the middle of the frequency bands of interest.

FIG. 7 illustrates graphically the simulated radiation pattern of the same antenna at 2.45 GHz and FIG. 8 illustrates the simulated radiation pattern at 5.5 GHz. Both radiating patterns are substantially omnidirectional, in a plane that is substantially perpendicular to the substrate 402. In this example, such a plane is substantially parallel to the ground plane 410. The omnidirectional radiating pattern in both frequency bands can be achieved due to the connecting conductor 406 and the small capacitive coupling between the conductive plates 404, 408. As discussed above, this structure can ensure that current flowing through the two conductive plates 404, 408 is in-phase and therefore reinforces the radiation pattern.

Furthermore, when the antenna is operating in the higher frequency band as shown in FIG. 8, the antenna assembly 400 provides improved antenna gain in the plane parallel to the ground plane. This is illustrated in FIG. 8 where it can be seen that a greater proportion of the radiated energy is focused in a horizontal direction, as opposed to a vertical direction. The antenna gain in the higher frequency band may be advantageous in some examples as it can compensate for signal losses in the coaxial cable at these high frequencies. Such signal losses in the coaxial cable can be generally higher in the higher frequency band than in the lower frequency band.

FIGS. 9*a* to 9*c* illustrate an antenna 900 according to an alternative embodiment of the invention. FIG. 9*a* shows a front view of the antenna 900, FIG. 9*b* shows a back view of the antenna 900, and FIG. 9*c* shows a composite view of the front and back views of the antenna 900.

The principle difference between the antenna 900 of FIGS. 9*a* to 9*c* and the antenna of FIGS. 4*a* to 4*c* is the second conductive plate 908, and the structure that couples the feeding port 912 to the second conductive plate 908. The features of FIGS. 9*a* to 9*c* that are in common with the antenna of FIGS. 4*a* to 4*c* will not be described again here.

The second conductive plate 908 of this embodiment is substantially square, and does not have the frusto-triangular section of the antenna of FIGS. 4*a* to 4*c*. As indicated above, the frusto-triangular section of the second conductive plate of FIGS. 4*a* to 4*c* can increase the bandwidth at which the antenna can satisfactorily operate. In order to increase the bandwidth of the upper frequency band of the antenna 900 of FIG. 9, the feeding port 912 is coupled to the second conductive plate 908 at two laterally spaced apart locations 936, 938.

The feeding port 912 is coupled to a connecting conductor 906, such as a via through the substrate 902. On the rear surface of the substrate 902, as shown in FIG. 9*b*, the connecting conductor 906 is electrically connected to the second conductive plate 908 by two conductive paths 930, 932, 934 that meet the second conductive plate 908 at two separate locations 936, 938. In this way, current distribution through the second conductive plate 908 is spread in a lateral direction thereby increasing the fractional bandwidth of signals in the higher frequency band that can be received at, or transmitted from, the second conductive plate 908.

It will be appreciated that the antennas of FIGS. 4*a* to 4*c* and 9*a* to 9*c* are only examples of an embodiment of the invention, that the dimensions illustrated are not to be considered as limiting, and that the antenna can be designed to be suitable for other frequency bands.

One or more embodiments disclosed herein relate to a dual band antenna assembly operating against a ground plane that comprises a lower band antenna and a higher band antenna. Each of these antennas comprises an antenna element (also referred to herein as a conductive plate) with a feeding end and an open end. The respective antenna elements are weak capacitive coupled. In addition, the respective antenna elements are electrically coupled at the respective feeding ends via an antenna coupling short (also referred to as connecting conductor herein).

The invention claimed is:

1. A multiband antenna comprising:

a substrate having a first surface and a second surface, wherein the second surface is on an opposite side of the substrate relative to the first surface;

a first conductive plate on the first surface of the substrate;

a second conductive plate on the second surface of the substrate, wherein the second conductive plate at least partially overlaps the first conductive plate in a plane of the substrate;

a ground plane, wherein the substrate is connected to the ground plane and is substantially perpendicular to the ground plane;

a single feeding port that provides a direct electrical connection to each of the first conductive plate and the second conductive plate, wherein the first conductive plate is configured to transmit or receive signals in a first frequency band and the second conductive plate is configured to transmit or receive signals in a second frequency band.

2. The antenna of claim 1, wherein the first and second conductive plates extend away from the ground plane in a longitudinal direction.

3. The antenna of claim 2, wherein physical lengths of the first and second conductive plates in the longitudinal direction define the frequencies of signals that the plates are configured to transmit and receive.

4. The antenna of claim 2, wherein a physical length of the first conductive plate in the longitudinal direction corresponds to a quarter wavelength of the frequency of the signal that the first conductive plate is configured to transmit and receive, and a physical length of the second conductive plate in the longitudinal direction corresponds to a quarter wavelength of the frequency of the signal that the second conductive plate is configured to transmit and receive.

5. The antenna of claim 1, wherein less than about 15% of the length of the second conductive plate overlaps the first conductive plate.

6. The antenna of claim 1, wherein less than about 45% of the length of the first conductive plate overlaps the second conductive plate.

7. The antenna of claim 1, wherein a proportion of the first conductive plate that overlaps the second conductive plate is at least 10%.

8. The antenna of claim 1, further comprising:

a connecting conductor that is configured to provide a direct electrical connection between the first conductive plate, the second conductive plate and the feeding port.

9. The antenna of claim 8, wherein the connecting conductor is a via that passes through the substrate.

10. The antenna of claim 1, wherein the first conductive plate is rectangular.

11. The antenna of claim 1, wherein the second conductive plate has a substantially square or rectangular section at an open end, and a frusto-triangular section at a feeding end.

12. The antenna of claim 1, wherein the first conductive plate is configured to transmit and receive signals with a frequency of about 2.5 GHz.

13. The antenna of claim 1, wherein the second conductive plate is configured to transmit and receive signals with a frequency greater than about 5 GHz.

14. The antenna of claim 1, wherein the single feeding port is coupled to the second conductive plate at two laterally spaced apart locations.

15. The antenna of claim 1, wherein the single feeding port is configured to be connected to an inner conductor of a coaxial cable.

16. The antenna of claim 1, wherein the ground plane is configured to be connected to a conducting shield of a coaxial cable.

17. The antenna of claim 1, wherein each conductive plate comprises a feeding end and an open end.

18. The antenna of claim 17, wherein the feeding end of the first conductive plate and the feeding end of the second conductive plate are both directly coupled to a connecting conductor.

19. The antenna of claim 17, wherein a lateral width of the second conductive plate is smaller at the feeding end than at the open end.

20. The antenna of claim 18, wherein a distance between the connecting conductor and each feeding end is at least ten times less than a distance between the connecting conductor and each open end.

* * * * *